US005360355A

United States Patent [19]

Ehrler et al.

[11] Patent Number: 5,360,355

[45] Date of Patent: Nov. 1, 1994

[54] CONTACT APPARATUS

[75] Inventors: Hans P. Ehrler, Maulburg, Germany; Roger Moll, Raedersdorf, France; Rudolf Neidecker, Basel, Switzerland

[73] Assignee: Multi-Contact AG, Allschwil, Switzerland

[21] Appl. No.: 56,381

[22] Filed: May 4, 1993

[30] Foreign Application Priority Data

May 8, 1992 [EP] European Pat. Off. ..... 92810340.7

[51] Int. Cl.[5] ..... H01R 4/48

[52] U.S. Cl. ..... 439/816; 439/927

[58] Field of Search ..... 439/801, 816, 827, 927

[56] References Cited

U.S. PATENT DOCUMENTS

| | | | |
|---|---|---|---|
| 3,895,853 | 7/1975 | Neidecker | 439/816 |
| 4,080,033 | 3/1978 | Deal | 439/816 |
| 4,191,445 | 3/1980 | Deal | 439/816 |

FOREIGN PATENT DOCUMENTS

| | | |
|---|---|---|
| 0430483A1 | 6/1991 | European Pat. Off. . |
| 2501003 | 7/1976 | Germany . |
| 3940652A1 | 6/1991 | Germany . |

OTHER PUBLICATIONS

Electronic Packaging & Production, Bd. 31, Nr. 12, Dec. 1991, Newton, Mass. US, Seiten 38–39, T. Antzack "Trends in Automotive Interconnection".

*Primary Examiner*—Gary F. Paumen

*Attorney, Agent, or Firm*—Oblon, Spivak, McClelland, Maier & Neustadt

[57] ABSTRACT

In a contact apparatus (4) for providing an electrical contact (1) between two flatly overlapping, current carrying conductor elements, particularly in the form of conducting bars and flat plates, the contact apparatus (4) being positioned and compressed between the conductive elements, and at least one resiliently compressible contact element along with at least one support element located adjacent the contact element for the purpose of limiting the compression of the at least one contact element, the at least one contact element and the at least one support element, in order to attain a flexible match to variable connector geometries, are shaped as separate contact modules (5*a–d*) and support modules (6*a–d*) which may be combined together.

7 Claims, 2 Drawing Sheets

1
2a
2b
3a
3b
4
5
5a
5b
5c
5d
6
6a
6b
6c
7a
7b
8
8(7a)
8(7b)
9
9(13a)
9(13b)
10
11
12
14a
14b

CONTACT APPARATUS

TECHNICAL FIELD

The present invention has to do with the area of electrical connectors. It relates to a contact apparatus to allow electrical contact between too flatly overlapping, current-carrying conductive elements, particularly in the form of bus bars and flat plates, the contact apparatus being positioned and compressed between the conductive elements, and including at least one resiliently compressible contact element as well as at least one support element positioned adjacent a contact element in order to limit the compression of the at least one contact element.

STATE OF THE ART

In the electrical area it is generally known that larger flat contact surfaces, for example two overlapping bus bars, do not guarantee reliable current transfer. Only a relatively few contact points occur between the contact surfaces of such plates. Under substantial current flow, these contact points carry too great a load and become hot. As the temperature rises, the rate of oxidation increases, leading to a deterioration and further heating of the contact points. Commonly, accidents and in particular fires can be traced back to this phenomenon.

Because of the above-described disadvantages, various attempts have been made to eliminate the described uncertainty in the connecting together of electrical contact plates. For example, it is known to roughen the contacting surfaces of the contact plates, or to melt segments thereof, or to place between the plates a small-mesh screen of sheet copper or the like or foil sheets. These approaches, however, even when the contact surfaces are additionally amalgamated, do not provide satisfying solutions if mechanical stresses simultaneously arise, particularly in the form of vibrations which can cause the fasteners to loosen. Furthermore, internal layers of sheet copper or the like tend to creep, leading to further loosening of the fasteners. Although it is also known to use spring washers in order to improve the electrical contact in an electrical connector utilizing threaded fasteners, it is found that the electrical drawbacks already mentioned again arise.

It has already been suggested, in the connecting together of conductive plates using threaded fasteners, to insert, as contact devices specially constructed spring washers which include contact elements in the form of contact lamellae connected at both ends to edge strips of the washer body and which are bent out of the plane of the washer body by being offset with respect to the longitudinal axis, the spring washers being resiliently compressed and preferably having a particular shape at the edge portion which provides linear contact with the conductor plates.

However, problems arise in the use of these known spring washers, in that when the connection is assembled, i.e. when the threaded fasteners are tightened, the resilient deflection of the spring washers cannot be adjusted in a definite way. Instead, the washer body itself serves as the "stop", when the contact lamellae are completely compressed.

As described in DE-OS 25 01 003, it is suggested, in order to resolve these problems, that collars be provided at the inner and outer edges of the "circular" spring washers, which include the already described contact lamellae as contact elements, the collars constituting stop elements and having heights which are such as to limit to a predetermined value the spacing between the conductor plates when they are in the screwed-together position, the heights being greater than the thickness of the spring body.

An integrated construction involving contact and support elements in a single spring washer, of the kind just mentioned, has, however, the result that the individual contact apparatus is not flexibly adaptable to various connector geometries, and instead special washer sizes must be made and warehoused for each particular application. Moreover, the contact elements are not protected against the surrounding conditions, so that oxidation problems or the deterioration of the individual contacts can again arise. The sealing of the contact elements (known per se) is however made much more difficult because of the integral contact elements.

DESCRIPTION OF THE INVENTION

Accordingly, it is an object of an aspect of the present invention to provide a contact apparatus which, using flexible contact elements, is adaptable to different contact geometries, and can be provided easily with additional sealing.

This object is obtained, in a contact apparatus of the kind previously described, in that at least one contact element and at least one support element are provided as separate contact and support modules respectively, which can be combined together.

The invention provides for the entire contact apparatus to be constructed of single (standardized) contact modules and support modules, from which a contact apparatus of larger surface area can be assembled in any desired way by combining or alternating. By separating the different functions into modules, it becomes easily possible to surround both the contact element and the support element with separate sealing means.

A first preferred embodiment of the invention is characterised in that the contact module and the support module are constructed so as to be capable of connection with each other. This makes it possible to easily assemble together the individual modules in accordance with the measurements of the particular connector geometry, to provide pre-assembled mats.

A second preferred embodiment of the invention is characterised in that:

(a) each contact module and support module has a peripherally running, closed module frame;

(b) in the contact module within the module frame there is secured a contact metal sheet with a plurality of contact lamellae which project away from the plane of the contact sheet on both sides;

(c) in the support module within the module frame there is secured an abutment plate of which the thickness is smaller than the maximum depth of the contact lamellae projecting to both sides, and whose thickness is greater than the thickness of the contact metal sheet itself; and (d) the module frames are constructed on the inside to provide a peripheral seal, and on the outside to provide module connecting elements, particularly in the form of pressure-snap engagement elements.

BRIEF DESCRIPTION OF THE DRAWINGS

Various embodiments of the invention are described below with reference to the drawings wherein.

DETAILED DESCRIPTION OF THE INVENTION

Figures 1, 2A, 2B, 3A, 3B:
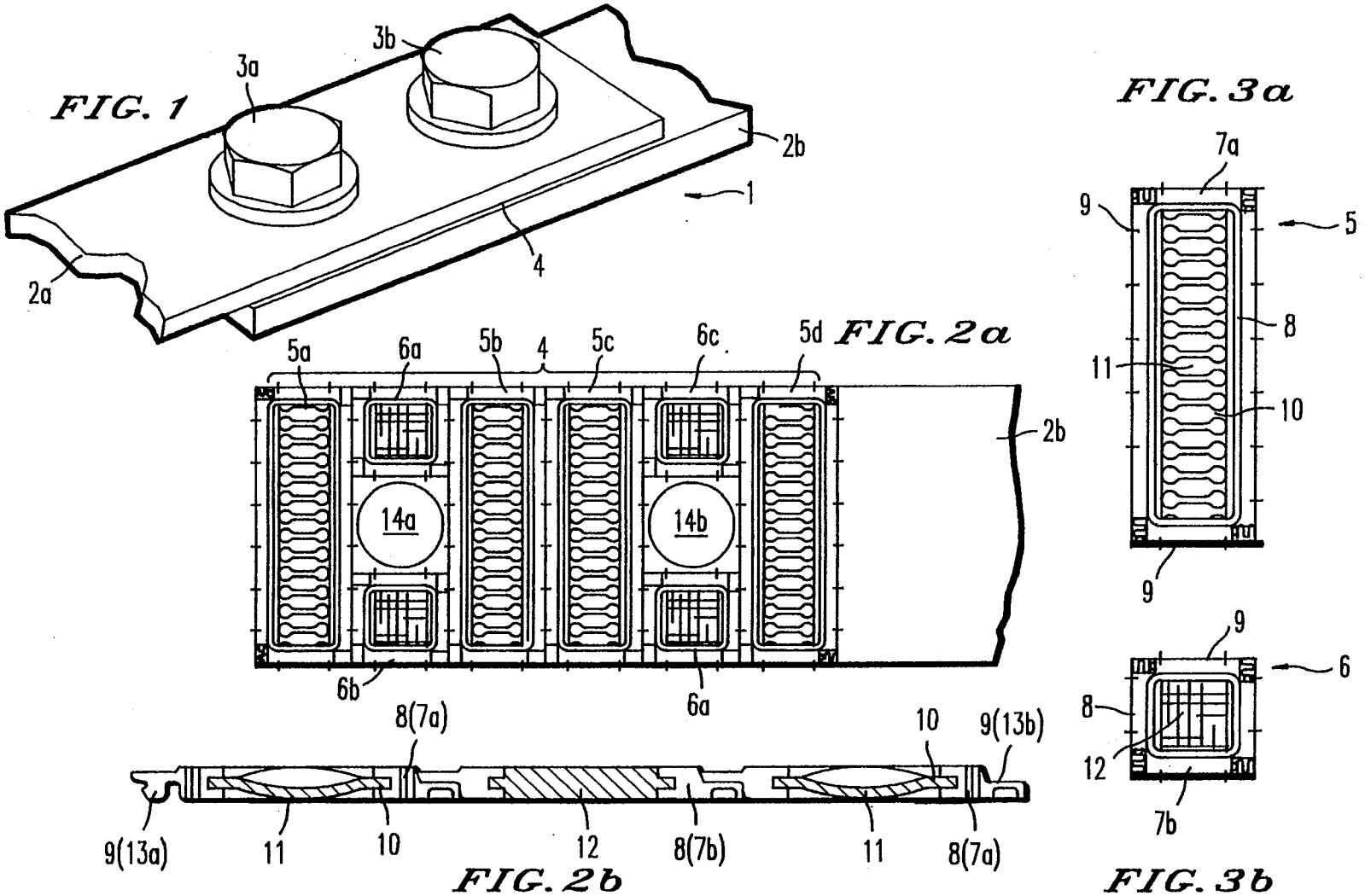
FIG. 1 is a perspective representation of an example of a screwed-together electrical connection between two conductor plates with a contact device lying therebetween, for which the invention can be utilized.
FIG. 2*a* is a plan view of an arrangement of contact modules and support modules for the electrical connector of FIG. 1, in accordance with a preferred embodiment of the invention.
FIG. 2*b* is a sectional view through a combination consisting of a central support module and two outwardly lying contact modules, the modules being connected by way of module connector elements, in accordance with a preferred embodiment of the invention.
FIG. 3*a* is a plan view of an individual contact module in accordance with FIG. 2*a;*
FIG. 3*b* is a plan view of an individual support module in accordance with FIG. 2*a;*

The invention will be more particularly described below using the example of a bolted-together electrical connection between two conductor plates, as illustrated in FIG. 1. The electrical connection 1 between the two conductor plates 2*a* and 2*b* is constructed such that the two conductor plates 2*a* and 2*b* are in flat overlapping relation and are tightly pressed together by connector fasteners 3*a* and 3*b*. The connector fasteners 3*a,b* may be either screwed into corresponding threaded bores in the lower conductor plate 2*b*, or screwed into corresponding nuts on the underside of the lower conductor plate 2*b*.

To create a reliable electrical contact between the conductor plates 2*a,b*, a contact device 4 for is provided between the contact surfaces, the contact device 4 being resiliently compressed as the fasteners are tightened. According to the invention, the contact device 4, which preferably extends over the entire contact surface, consists—as shown in FIG. 2*a* as an example—of separate contact modules 5*a* to 5*d* and support modules 6*a* to 6*d*. The individual modules are provided in standardized form and standardized dimensions. They are variably combined with each other in such a way that, on the one hand, the available contact surface is covered with the largest possible number of contact modules 5*a–b*, and on the other hand an adequate number of support modules 6*a–b* are distributed over the contact surfaces in such a way as to ensure a balanced pressure distribution and fastener support.

In the connector embodiment shown in FIG. 2*a*, in which two bores 14*a* and 14*b* are provided for the fasteners 3*a* and 3*b*, there is further provided, surrounding each bore 14*a*, 14*b*, a combination which includes two elongate, rectangular contact modules 5*a,b* (5*c,d*) and two square support modules 6*a,b*, (6*c,d*) lying between them. The dimensions of the contact modules 5*a–d* are preferably so selected that they have a side ratio of 3:1, and such that the shorter side has the same length as the side length of the square support modules 6*a–d*.

The module size is so selected as to make possible, inter alia: the threaded connection of conductor plates of rectangular section according to DIN 43673, Part 1; the flat contact for electrical machinery according to DIN 46206, Part 2, with a width equal to or greater than 40 mm; and the rated currents set out in DIN 46206, or in DIN 43670 and 43671. In practice, for example, side lengths of 13.33 mm (for the square sides and the short rectangular side) and 40 mm (for the long rectangular side) have proven reliable. Beside the square support modules 6*a–d* (the so-called 1/3-modules) there can be provided additional rectangular "1/1-modules" having the same outer dimensions as the contact modules 5*a–b*, in order to increase the flexibility of the system. Thus for example it is conceivable to replace one or more of the contact modules 5*a–d* in FIG. 2*a* with a corresponding 1/1 support module. Other dimensional variations are also conceivable, in so far as systematically larger-surfaced units can be constructed therefrom.

The individual modules, i.e. the rectangular contact module 5 and the square support module 6, are separately illustrated in FIG. 3*a* and 3*b*. Each module includes a rectangular or square module frame 7*a* or 7*b* which is closed and which runs peripherally. In the frame, a metal contact sheet 10 with contact lamellae 11 is secured in a groove. Similarly, in the support module 6 the support plate 12 is similarly supported. In order to protect the interior elements from the effects of the environment (for example an aggressive atmosphere), the module frames 7*a*, 7*b* are constructed so as to provide a peripheral seal 8 for the interior, the seal lying tightly against the inner surfaces of the conductor plates 2*a,b* when the electrical connection 1 is in the screwed-together condition, thus forming a sealed interior space for the metal contact sheet 10 and the support plate 12 respectively.

At the exterior, i.e. outside of the seal 8, the module frames 7*a*, 7*b* preferably have module connection components 9 permitting the linking together of individual modules 1 with each other. A preferred embodiment of the module connecting component 9 is illustrated in FIG. 2*b*, which shows in cross-section a combination of an internally positioned support module and two outwardly lying contact modules (corresponding to the combination 5*a*, 6*a* and 5*b* in FIG. 2*a*). The module connecting components 9 have here the form of a snap button element 13*a*, 13*b*, which permits the individual modules to be snapped together to form a larger unit. It will be obvious that other forms of connecting elements are conceivable, in order to meet the same aims.

Figure 5:
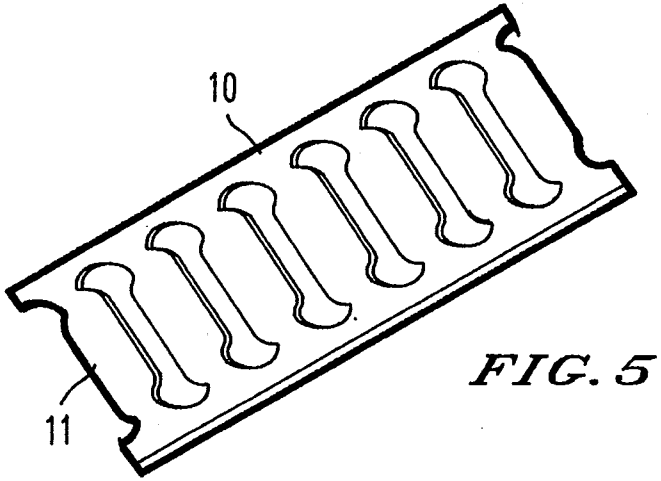
FIG. 5 is a perspective view of a contact sheet metal unit in accordance with FIG. 4.
Figure 4B:
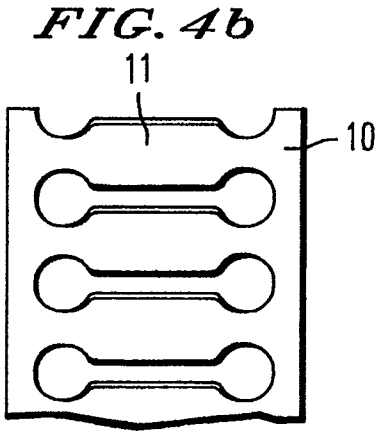
FIGS. 4*a–c* are various elevations and sections through a contact metal sheet with bent-out contact lamellae, in the condition preferred for use in the contact modules according to the invention.
Figure 4C:
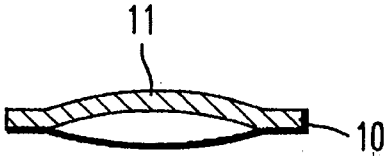
Figure 4A:
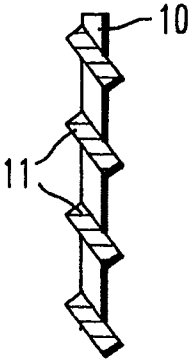

The already mentioned contact sheets 10 are preferably used as contact elements within the contact modules 5 and 5*a–d*, the plates 10 having a plurality of contact lamellae 11. As can be seen in the illustration of such a metal contact sheet 10 in FIG. 4*a–c* (wherein FIG. 4 is a plan view, FIG. 4*a* is a longitudinal section and FIG. 4*c* is a cross-section) and in FIG. 5 (a perspective view), the contact lamellae 11 are shaped as elements which project in both directions beyond the edge plane of the contact sheet 10 and are bent so as to be offset about the longitudinal axis. Preferably, the edges of the contact lamellae 11 are curvilinear in order to attain a line contact. As an example, 14 of such contact lamellae 11 can be provided per contact module. A suitable material for the contact sheet 10 is a spring alloy which is such that the upper surface of the lamellae 11 can be silver plated.

If we take an example thickness of 0.5 mm for the contact plate 10, and a maximum depth of 1.6 mm for the depth to which the contact lamellae 11 project to both sides, a brass or copper plate with a thickness of 1.2 mm can be selected for the support plate 12 in the support modules 6, *6a–b*, so that when the electrical connector is screwed together, the contact lamellae 11 are compressed only to a predetermined degree or are placed under only a predetermined resilient stress.

An elastic, temperature resistant plastic is preferred for the module frames *7a,b* with their integral seal 8, so that the seal 8 and the module connection components 9 can be formed as integral parts of the frame.

We claim:

1. A contact apparatus useful for establishing an electrical connection between two, flatly overlapping, current conducting elements, the contact apparatus lying between and compressed by the current carrying elements and including at least one, spring-action compressible contact element as well as at least one support element beside the contact element in order to limit the compression of the at least one contact element, said at least one contact element and said at least one support element are formed as separate contact modules and support modules respectively, which may be combined with each other;

wherein the contact modules and the support modules are constructed so as to be connectable together; and wherein a) the contact modules and the support modules each have a peripherally running, closed module frame;

b) a contact metal sheet with a plurality of contact lamellae which project to both sides of the plane of the contact metal sheet, is secured to each respective contact module within the module frame; and c) a support plate is secured to each respective support module within the module frame, the thickness of the plate being smaller than the maximum depth to which the contact lamellae extend on both sides of the plane, the thickness of the plate being greater than the thickness of the contact metal sheet.

2. The apparatus according to claim 1, wherein the module frames are formed to provide a peripheral seal on the inside thereof, and to provide at the exterior thereof module connection elements, in particular having the form of pressure snap buttons.

3. The apparatus according to claim 2, wherein the module frames are made of an elastic, temperature-stable plastic.

4. The apparatus as claimed in claim 1, wherein, (a) the contact lamellae are formed as elements projecting in opposite directions with respect to the edge strips of the contact metal sheets and which are offset about the longitudinal axis out of the plane of the contact metal sheet; and (b) edges of the contact lamellae are curvilinear in order to attain line contact.

5. The apparatus as claimed in claim 1, wherein the module frames have essentially a rectangular form.

6. The apparatus as claimed in claim 5, wherein the module frames of the support modules are of a square shape, and the module frames of the contact modules have a side ratio of 3:1.

7. The apparatus ac claimed in claim 6, wherein the module frames of the support modules also have a side ratio of 3:1.

* * * * *